US006959558B2

(12) United States Patent
Bean, Jr. et al.

(10) Patent No.: US 6,959,558 B2
(45) Date of Patent: Nov. 1, 2005

(54) SYSTEMS AND METHODS FOR HEAD PRESSURE CONTROL

(75) Inventors: John H. Bean, Jr., Wentsville, MO (US); James Richard Roesch, St. Peters, MO (US)

(73) Assignee: American Power Conversion Corp., West Kingston, RI (US)

( * ) Notice: Subject to any disclaimer, the term of this patent is extended or adjusted under 35 U.S.C. 154(b) by 203 days.

(21) Appl. No.: 10/382,381

(22) Filed: Mar. 6, 2003

(65) Prior Publication Data

US 2004/0172957 A1 Sep. 9, 2004

(51) Int. Cl.[7] ..... F25D 17/00

(52) U.S. Cl. ..... 62/180; 62/181; 62/183; 62/185

(58) Field of Search ..... 62/180, 181, 183, 62/185, 506, 228.3

(56) References Cited

U.S. PATENT DOCUMENTS

| | | | | | |
|---|---|---|---|---|---|
| 3,934,425 | A | | 1/1976 | Morris | 62/117 |
| 4,060,997 | A | * | 12/1977 | Shultz et al. | 62/180 |
| 4,250,759 | A | * | 2/1981 | Vago et al. | 73/723 |
| 4,735,060 | A | * | 4/1988 | Alsenz | 62/225 |
| 5,050,392 | A | * | 9/1991 | Messmer et al. | 62/114 |
| 5,150,581 | A | | 9/1992 | Smith | 62/115 |
| 5,226,595 | A | * | 7/1993 | Devera et al. | 237/2 A |
| 5,457,965 | A | * | 10/1995 | Blair et al. | 62/129 |
| 5,579,648 | A | * | 12/1996 | Hanson et al. | 62/126 |
| 5,752,390 | A | | 5/1998 | Hyde | 62/196.4 |
| 6,073,457 | A | * | 6/2000 | Kampf et al. | 62/179 |
| 6,192,700 | B1 | * | 2/2001 | Runk et al. | 62/228.5 |
| 6,202,425 | B1 | | 3/2001 | Arshansky et al. | 62/119 |
| 6,332,496 | B1 | * | 12/2001 | Takano et al. | 165/202 |
| 6,357,242 | B1 | | 3/2002 | Farley et al. | 62/133 |
| 6,381,545 | B1 | * | 4/2002 | Goubeaux et al. | 702/35 |
| 6,467,291 | B1 | * | 10/2002 | Takano et al. | 62/228.3 |
| 6,484,520 | B2 | * | 11/2002 | Kawaguchi et al. | 62/133 |
| 6,637,219 | B2 | * | 10/2003 | Leisenheimer et al. | 62/132 |
| 6,701,732 | B2 | * | 3/2004 | Shimoda | 62/228.3 |
| 2002/0011074 | A1 | * | 1/2002 | Suitou et al. | 62/228.3 |

FOREIGN PATENT DOCUMENTS

JP 406147662 A * 5/1994

* cited by examiner

*Primary Examiner*—William E. Tapolcai
*Assistant Examiner*—Mohammad M. Ali
(74) *Attorney, Agent, or Firm*—A. Jason Mirabito, Esq.; Mintz, Levin; C. Eric Schulman

(57) ABSTRACT

The present invention relates to systems and methods for controlling head pressure in a vapor compression system, e.g. in a precision air conditioning system. One embodiment of the invention provides a method for regulating working fluid flow in a vapor compression system including a compressor. The method includes: providing a controller; receiving signals at the controller representative of a monitored discharge pressure in a discharge line of the compressor; and using the controller to provide a control signal to an actuator that controls a flow control valve that, in turn, controls working fluid flow into the system, the control signal being responsive at least in part to a difference between a set point pressure and the monitored discharge pressure.

15 Claims, 5 Drawing Sheets

SYSTEMS AND METHODS FOR HEAD PRESSURE CONTROL

BACKGROUND OF THE INVENTION

The present invention relates to a vapor compression system, e.g., used for air conditioning, and more specifically to systems and methods for controlling head pressure in a vapor compression system.

The condensing pressure at which a condenser in a vapor compression system operates depends upon a number of factors such as the design conditions for which the condenser was selected, the actual conditions at which the condenser is operating, and whether the condenser is operating at full or partial capacity. In many cases, the condenser operates at full capacity at all times. In such situations, the pressure at which the condenser operates fluctuates as a result of changes in the ambient conditions such as outside air temperature or humidity. Because of these condensing pressure fluctuations, refrigeration or air conditioning systems utilizing compressors typically operate where the internal discharge pressure of the compressor does not equal the condensing or discharge line pressure resulting in a condition of either "over-compression" or "under-compression".

In the under-compression case, the internal discharge pressure is too far below the discharge line pressure. Energy is wasted because the compressor must work against this relatively high pressure differential. In the over-compression case, the internal discharge pressure is too high relative to the discharge line pressure. As a result, the condenser does not operate efficiently because the compressor does not provide the appropriate operating pressure to the condenser.

SUMMARY OF THE INVENTION

The present invention relates to systems and methods for controlling head pressure in a vapor compression system, e.g. in a precision air conditioning system. One embodiment of the invention provides a method for regulating working fluid flow in a vapor compression system including a compressor. The method includes: providing a controller; receiving signals at the controller representative of a monitored discharge pressure in a discharge line of the compressor; and using the controller to provide a control signal to an actuator that controls a flow control valve that, in turn, controls working fluid flow into the system. The control signal is responsive at least in part to a difference between a set point pressure and the monitored discharge pressure.

Another embodiment of the invention provides an apparatus for regulating working fluid flow. The apparatus includes: a vapor compression system, a discharge pressure sensor, a flow control valve, a flow control valve actuator, and a controller. The vapor compression system includes: a compressor having an outlet for a working fluid; a discharge line attached to the compressor outlet; and a condenser having a first inlet coupled to the discharge line. The discharge pressure sensor couples to the discharge line and provides a discharge pressure signal representative of the discharge pressure. The flow control valve has an inlet for receiving working fluid and an outlet. The outlet connects to the vapor compression system. The flow control valve controls the flow of the working fluid into the vapor compression system. The flow control valve actuator couples to the flow control valve. The actuator controls the flow control valve. The controller communicates with the discharge pressure sensor and with the actuator. The controller receives the discharge pressure signal and controls the actuator at least in part in response to the discharge pressure signal.

BRIEF DESCRIPTION OF THE ILLUSTRATES EMBODIMENTS

DETAILED DESCRIPTION OF THE INVENTION

The present invention relates to vapor compression systems, e.g., air conditioning systems, and more specifically to systems and methods for electronically controlling head pressure in a vapor compression system.

Figure 1:
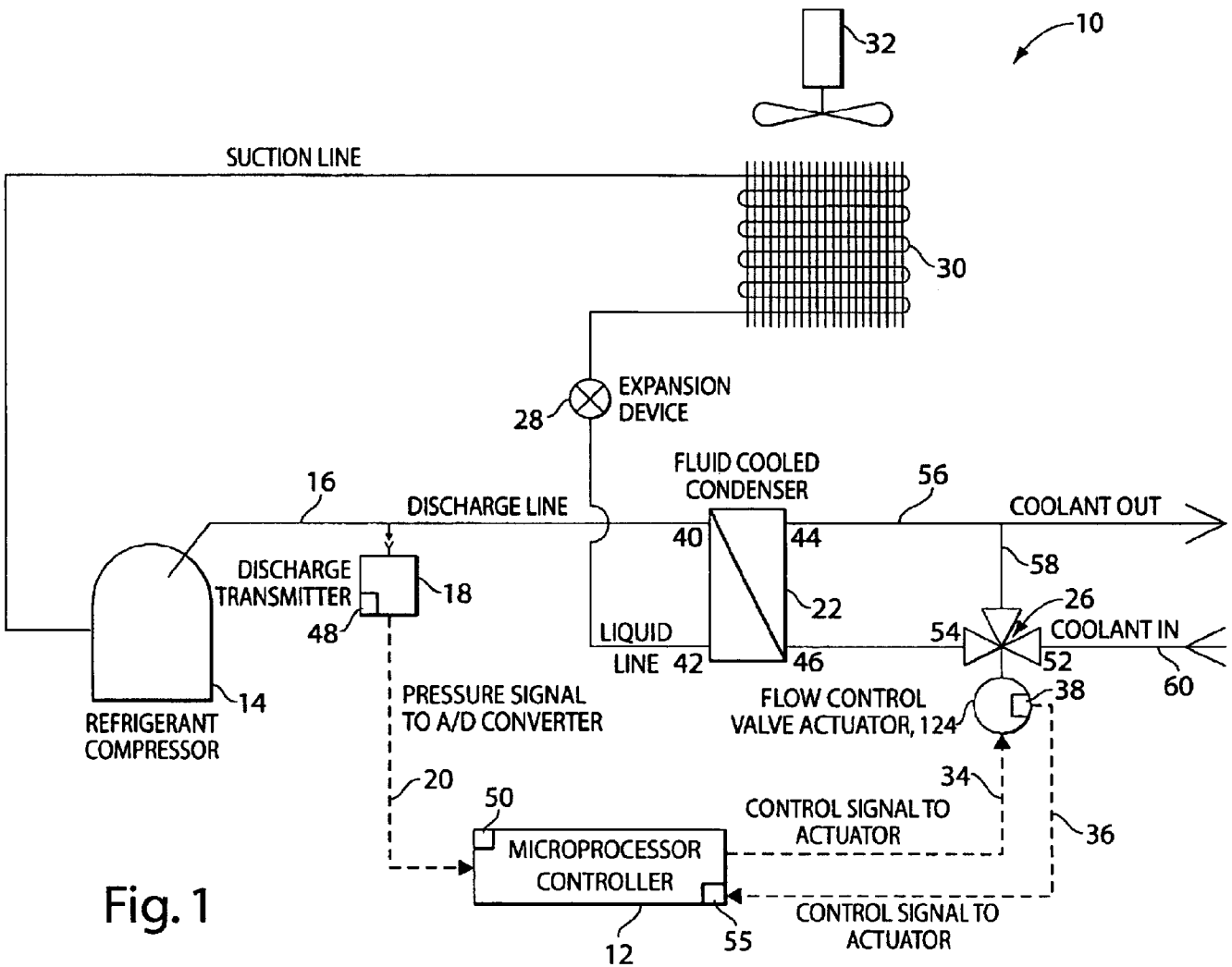
FIG. 1 is a schematic illustration of a vapor compression system according to one embodiment of the invention.

With reference to FIG. 1, an apparatus 10 according to one embodiment of the invention includes a vapor compression system having a compressor 14 with an inlet and an outlet; a discharge line 16 coupled to the compressor outlet; and a condenser with a first inlet 40 coupled to the discharge line 16, a first outlet 42 for passing working fluid to an expansion device 28, a second inlet 46 for receiving working fluid from a conventional working fluid recycling system (not shown); and a second outlet 44 for returning working fluid to the working fluid recycling system. The working fluid can be one of a variety of fluids such as water or glycol. The vapor compression system further includes a liquid line coupled to the first outlet 42 of the condenser 22, an expansion device 28 coupled to the liquid line, an evaporator 30 coupled to the expansion device, a fan 32 for blowing air across the evaporator 30, and a suction line coupled to the evaporator 30 and to the inlet of the compressor 14. Embodiments of the invention use a coolant-cooled, e.g., glycol or water, brazed plate heat exchanger for the method of heat rejection from the refrigerant condenser.

The apparatus further includes: a pressure sensor 18, 48, 50 coupled to the discharge line 16; a flow control valve 26 having an inlet 52 for receiving working fluid and an outlet 54 connected to the second inlet 46 of the condenser; an actuator 24 coupled to the valve 26; and a controller 12 in communication with the pressure sensor 18, 48, 50 and in communication with the actuator 24. In one embodiment, the actuator includes a feedback potentiometer 38 for measuring valve position and for providing a signal representative of the valve position.

A coolant out line 56 couples to the second outlet 44 of the condenser. A coolant in line 60 couples to the inlet 52 of the flow control valve. The coolant out line and the coolant in line couple to a conventional working fluid/coolant recycling system (not shown). A bypass line 58 couples the coolant out line 56 to the flow control valve 26. The bypass line allows the recycling system to continue cycling fluid when the flow control valve is shut.

The pressure sensor can include a pressure transducer 18, an op-amp 48 and an analog-to-digital (A/D) converter. In one embodiment, the pressure sensor obtains a pressure measurement every second. The pressure transducer 18 coupled to the discharge line 16 provides a transducer pressure signal representative of the pressure in the discharge line 16. The op-amp 48 coupled to the transducer 18 converts the transducer pressure signal to an amplified pressure signal. The A/D converter 50 receives the amplified pressure signal and converts it to a digital pressure signal. In one embodiment the A/D converter 50 is a conventional A/D converter and is embedded in the controller 12.

In the illustrated embodiment, the controller 12 receives the digital pressure signal from the A/D converter 50 and sends a control signal 34 to the actuator, the control signal being responsive at least in part to the digital pressure signal. The controller 12 can also receive the valve position signal 36 from the feedback potentiometer 38. An A/D converter 55 can convert the valve position signal 36 to a digital signal for processing by the controller and the controller 12 can produce a control signal 34 responsive at least in part to the valve position signal 36.

One can refer to the pressure in the discharge line as head pressure. The present invention maintains head pressure while reducing operation of the actuator 24 relative to current actuator-based air conditioning systems, thus reducing the need for repair and/or replacement of the actuator and/or valve. Embodiments of the invention monitor head pressure relative to a predetermined or set point head pressure. One can refer to the monitored head pressure minus a set point pressure as head error. In one embodiment, if the monitored head pressure is within a predetermined range of the set point head pressure, i.e., if the head error is below a specified level, then the system does not change the valve position.

Figure 2:
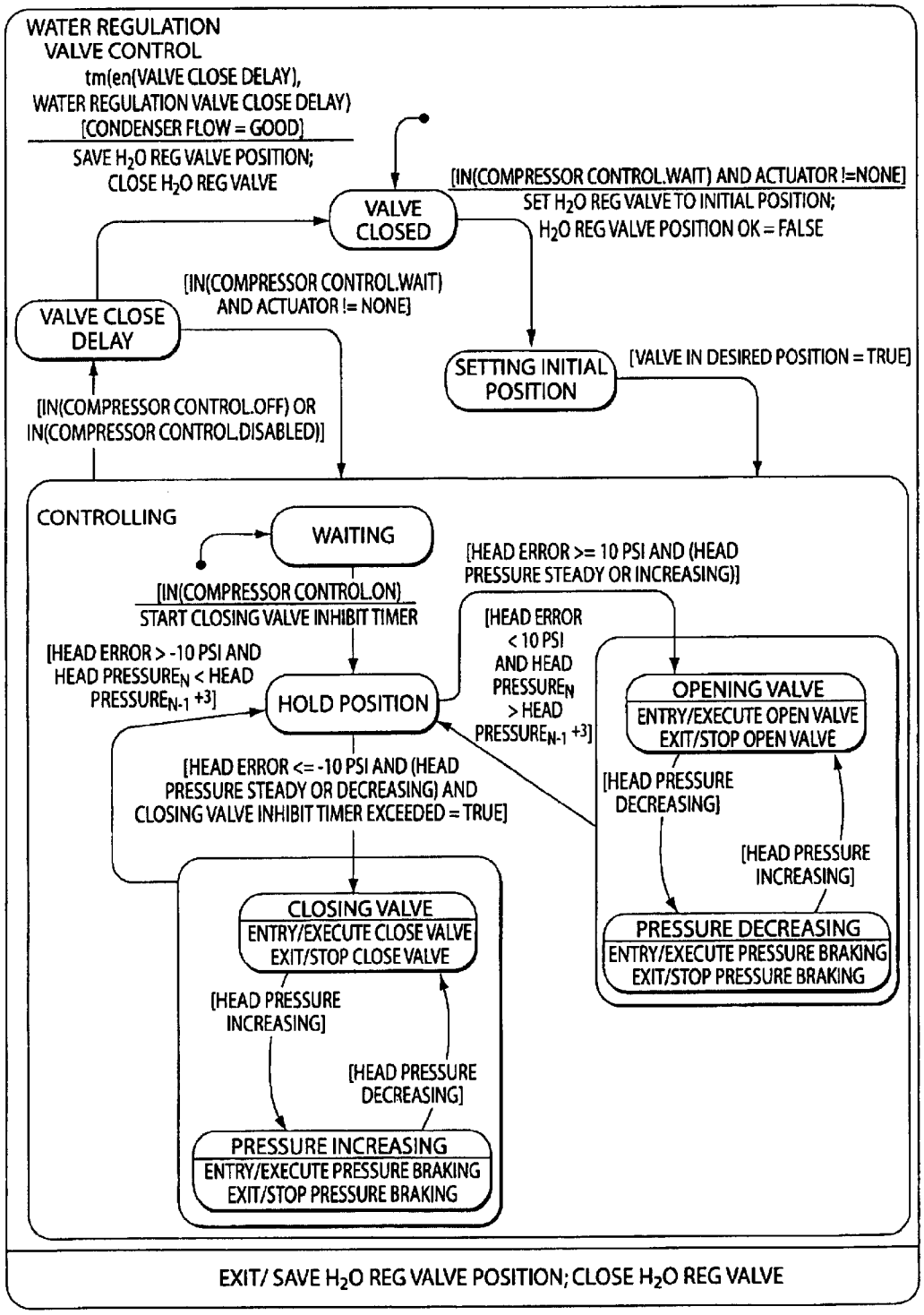
FIG. 2 is a state diagram for the controller of FIG. 1.

With reference to the controller state diagram of FIG. 2, in the initial state the controller is in a valve closed state. In one embodiment, the controller monitors a temperature control state machine to determine cooling demand. Once the temperature in the space in question increases above a selected temperature, the controller transitions to a setting initial position state in which the controller signals the actuator to set the valve to the initial position. By doing so, the system starts the flow of coolant into the compressor in preparation for operation of the vapor compression system including operation of the compressor.

Once the system sets the initial position, the system enters the controlling portion of the state diagram. The first state of the controlling portion is a wait state. In one embodiment, the controller waits for a transition control signal from the compressor state machine that indicates that the compressor has been started. Once the controller receives the transition control signal from the compressor state machine, the controller transitions to a hold position state. In one embodiment, while in the hold position, the system monitors the head error, the difference between the monitored head pressure and a predetermined/set point head pressure.

If the head error is above a preselected value, e.g., 10 psi, and if the pressure is not decreasing, then the system transitions to an opening valve state. Similarly, if the head error is below a preselected value, e.g., −10 psi, and if the pressure is not increasing, then the system enters a closing valve state.

Alternatively, if the controller is in the opening valve state, if the monitored discharge pressure minus the set point pressure is below a preselected value, e.g., 10 psi, and if the rate of change in the monitored discharge pressure is below a preselected value, then the controller enters the hold position state. Similarly, if the controller is in the closing valve state, if the monitored discharge pressure minus the set point pressure is above a preselected value, e.g., −10 psi, and if the rate of change in the monitored discharge pressure is below a preselected value, then the controller enters the hold position state.

When the controller enters the opening valve or closing valve state, the controller executes an open valve routine or a close valve routine, respectively. In one embodiment, when the controller enters the opening valve or closing valve state, the controller substantially immediately signals the actuator to open or close the valve, respectively.

One embodiment of the open valve routine is the following. As noted above, one can refer to the monitored discharge pressure minus a set point pressure as head error and the absolute value of head error as Working Head Error. If the Working Head Error is greater than 60 then the controller sets the Working Head Error to 60. If the Working Head Error is less than 10, the controller sets the Working Head Error to 10. Then the controller looks up the "Off Time" equation based on the working head error from Table I.

TABLE I

| Working Head Error | Equation | |
|---|---|---|
| Less Than | Slope | Intercept |
| 20 | 0.0029 | −0.009 |
| 30 | 0.0087 | −0.125 |
| 40 | 0.0116 | −0.212 |
| 50 | 0.0145 | −0.328 |
| 60 | 0.0203 | −0.618 |

Figure 3:
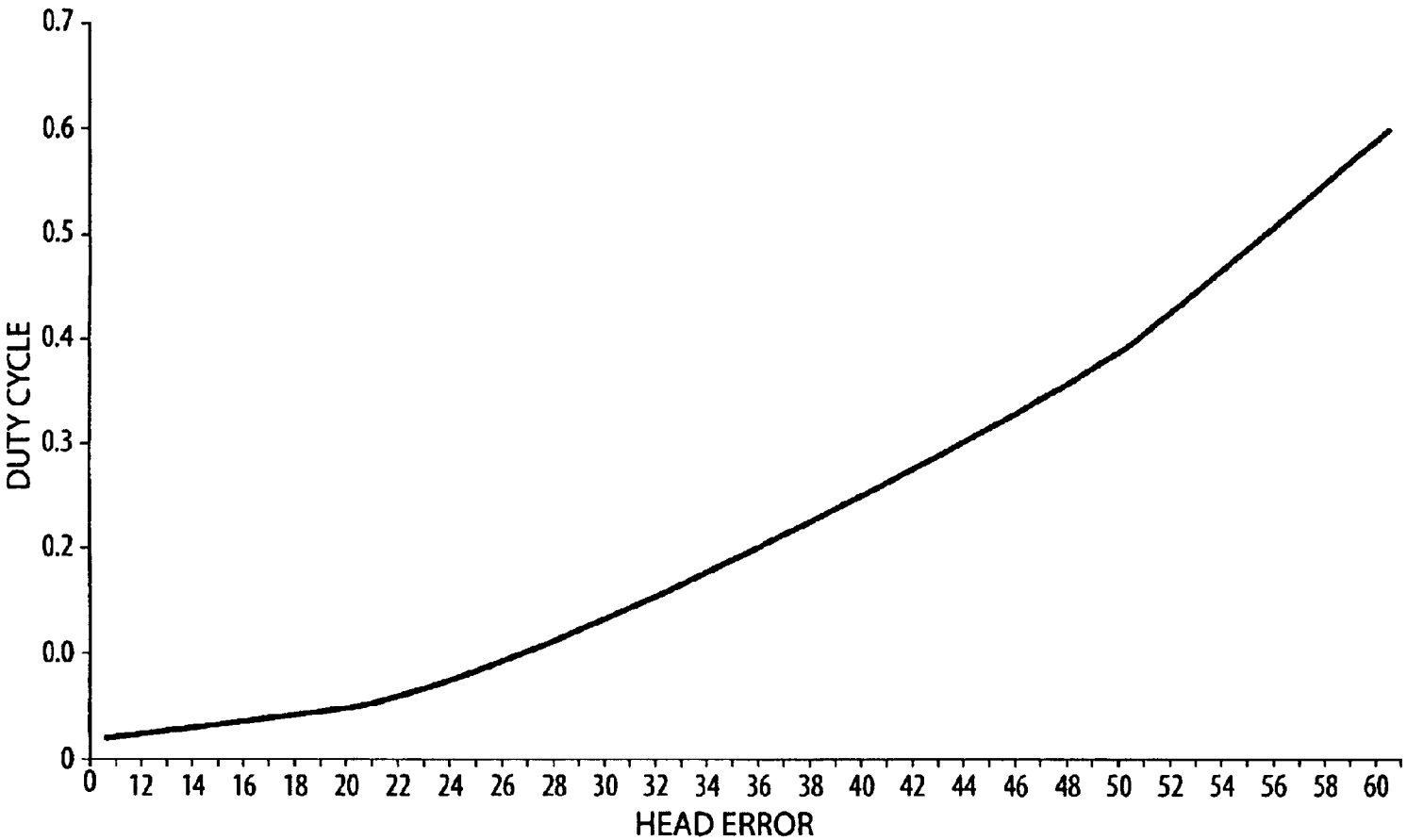
FIG. 3 is a graph of duty cycle for signals sent by the controller of FIG. 1 as a function of head error.

The controller sets the Off Time, i.e., the time for which the controller does not signal the actuator to open the valve, as follows:

Off Time=0.4*((1/(Slope*Working Head Error+Intercept))−1). The graph of the resulting duty cycle vs Working Head Error is shown in FIG. 3. By constraining the Working Head Error to a range of 10–60, the system constrains the duty cycle of the actuator to a range of 2%–60%.

In one embodiment, the open (or close) valve process calculates a new Off Time ever second.

Off Time and Valve Direction, e.g., open, are fed into a function performed on the controller that generates a pulse of selected length, e.g., of 0.4 seconds, on the appropriate valve direction signal whenever the Off Time is exceeded. The controller provides two signals to the actuator, one for closing the valve and one for opening the valve. On entrance to the Opening Valve, Closing Valve states, the controller sets Off Time to zero so that the controller substantially immediately generates a pulse from the controller to the actuator.

Similarly, one embodiment of the close valve routine is the following. If the Working Head Error is greater than 60 then the controller sets the Working Head Error to 60. If the Working Head Error is less than 10, the controller sets the Working Head Error to 10. Then the controller looks up the "Off Time" equation based on the working head error from Table I. The controller sets the Off Time, i.e., the time for which the controller does not signal the actuator to open the valve, as follows: Off Time=0.4*((1/(Slope*Working Head Error+Intercept))−1) Off Time and Valve Direction, i.e., close, are fed into a function performed on the controller that generates a pulse of selected length, e.g., of 0.4 seconds, on the appropriate valve direction signal whenever the Off Time is exceeded.

Once in the opening valve state, if the head pressure is decreasing, the controller enters the pressure decreasing state. Similarly, once in the closing valve state, if the head pressure is increasing, the controller enters the pressure increasing state. In one embodiment, when the controller enters the pressure decreasing or pressure increasing states, the controller substantially immediately signals the actuator to close or open the valve, respectively.

When the controller enters the pressure decreasing state, the controller executes a pressure-decreasing pressure braking routine. The pressure-decreasing pressure breaking routine reduces overcompensation for head error as a result of opening the valve to correct head error. The routine reduces such overcompensation by closing the valve once the discharge pressure starts decreasing.

One embodiment of the pressure-decreasing pressure breaking routine is the following. If the monitored discharge pressure is decreasing at a rate greater than or equal to 5 psi/sec, then the controller sets the Off Time to 0.4 seconds. If the discharge pressure is decreasing at a rate greater than or equal to 3 psi/sec but less than 5 psi/sec then the controller sets the Off Time to 0.6 seconds. Otherwise, as with the opening valve routine. If the Working Head Error is greater than 60 then the controller sets the Working Head Error to 60. If the Working Head Error is less than 10, the controller sets the Working Head Error to 10. Then the controller looks up the "Off Time" equation based on the working head error from Table I. The controller sets the Off Time, i.e., the time for which the controller does not signal the actuator to open the valve, as follows:

$$\text{Off Time}=0.4*((1/(\text{Slope}*\text{Working Head Error}+\text{Intercept}))-1).$$

Similarly, when the controller enters the pressure increasing state, the controller executes a pressure-increasing pressure braking routine. The pressure-increasing pressure breaking routine reduces overcompensation for head error as a result of closing the valve to correct head error. The routine reduces such overcompensation by opening the valve once the discharge pressure starts increasing.

One embodiment of the pressure-increasing pressure breaking routine is the following. If the monitored discharge pressure is increasing at a rate greater than or equal to 5 psi/sec, then the controller sets the Off Time to 0.4 seconds. If the discharge pressure is increasing at a rate greater than or equal to 3 psi/sec but less than 5 psi/sec then the controller sets the Off Time to 0.6 seconds. Otherwise, as with the opening valve routine. If the Working Head Error is greater than 60 then the controller sets the Working Head Error to 60. If the Working Head Error is less than 10, the controller sets the Working Head Error to 10. Then the controller looks up the "Off Time" equation based on the working head error from Table I. The controller sets the Off Time, i.e., the time for which the controller does not signal the actuator to open the valve, as follows:

$$\text{Off Time}=0.4*((1/(\text{Slope}*\text{Working Head Error}+\text{Intercept}))-1).$$

When the controller receives an off signal or a disable signal, i.e., a signal from the compressor state machine that the compressor has been turned off, the controller transitions to a valve close delay state. After a preselected period of time, the controller saves the current valve position to memory, closes the valve and transitions to a valve closed state. The system uses the save valve position as the initial valve position when the state machine transitions back to the Setting Initial Position state. In one embodiment, the controller is a microprocessor controller and the controller has flash memory that stores the firmware for the controller.

With reference to FIG. 3, the duty cycle for signals sent by the controller of FIG. 1 as a function of head error is shown for one embodiment of the invention. The graph depicted in FIG. 3 uses the off time equation provided by Table I. The head error is in units of pounds per square inch. Multiplying the values marking the Y axis by 100 gives the percentage of the duty cycle for which the controller provides an open or close signal to the actuator. In the illustrated embodiment, the period over which the duty cycle is calculated is 3 minutes long and the pulse length is 0.4 seconds. The length over which the duty cycle is calculated can vary as long as it is several times longer than the combination of the longest off time with the pulse length. As illustrated, the duty cycle increases with the head error.

Figure 4:
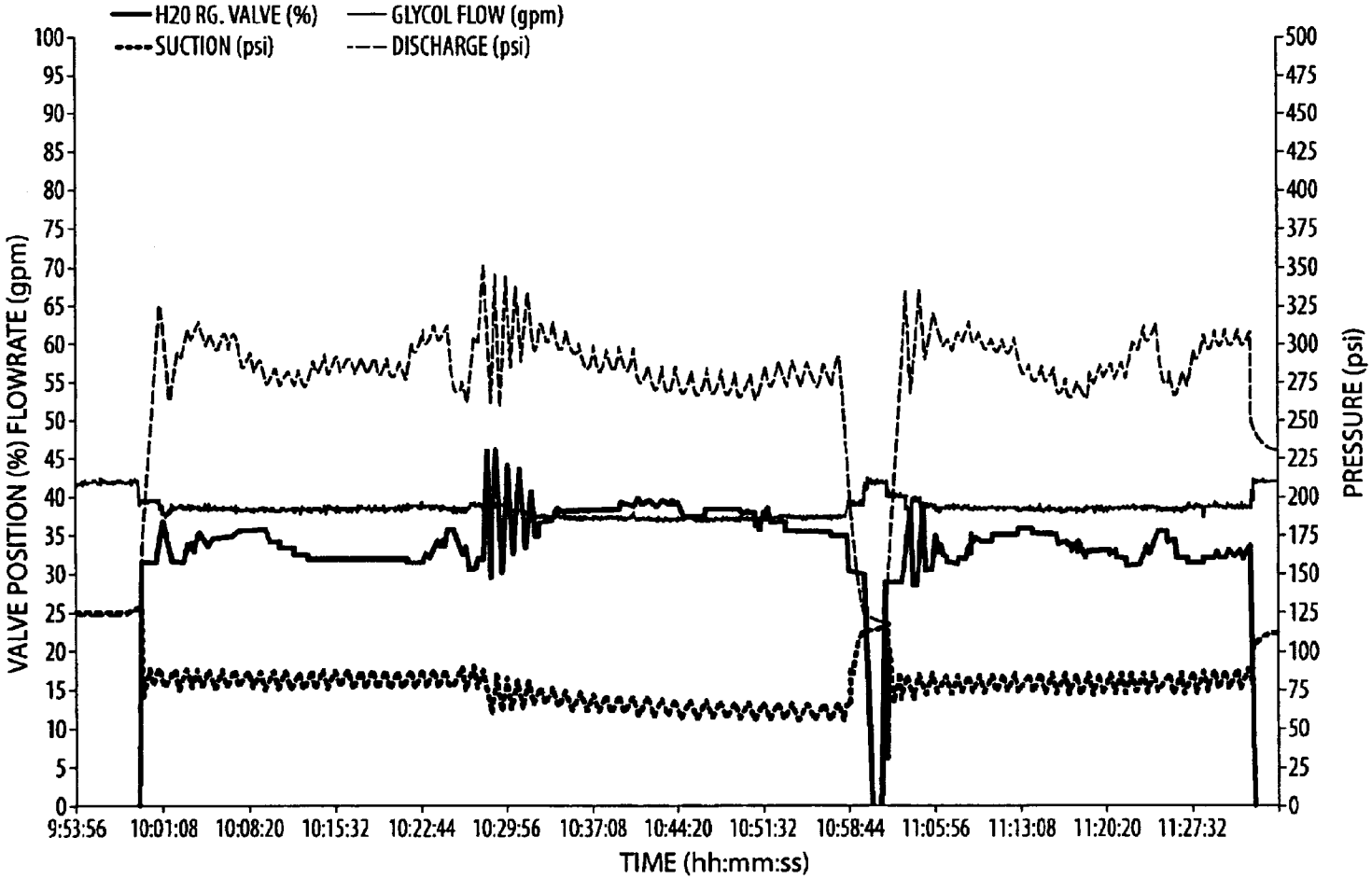
FIG. 4 is a graph depicting results of the operation of one embodiment of the system of FIG. 1.

With reference to FIG. 4, results of the operation of one embodiment of the system of FIG. 1 include discharge pressure in psi, working fluid flow in gallons per minute (gpm), valve position as a percentage of the fully open position, and suction pressure at the compressor inlet in psi. The X axis represents time in an hours, minutes, seconds format. The left-hand Y axis represents valve position as a percentage of the fully open position and the flow rate in gpm. The right-hand Y axis represents pressure in psi. The set point pressure is 280 psi. The graph illustrates that before the valve opens the discharge pressure is about 125 psi. As the discharge pressure rises and falls, the valve opens and closes in order to drive the discharge pressure to the set point. The controller makes small adjustments in the valve position over time to keep the discharge pressure near the set point pressure. At approximately 10:28:00, a second compressor was turned on which caused a disturbance in the discharge pressure. At approximately 11:00:00, an operator turned the unit off and then back on. As a result, the valve closed and the discharge pressure dropped.

Figure 5:
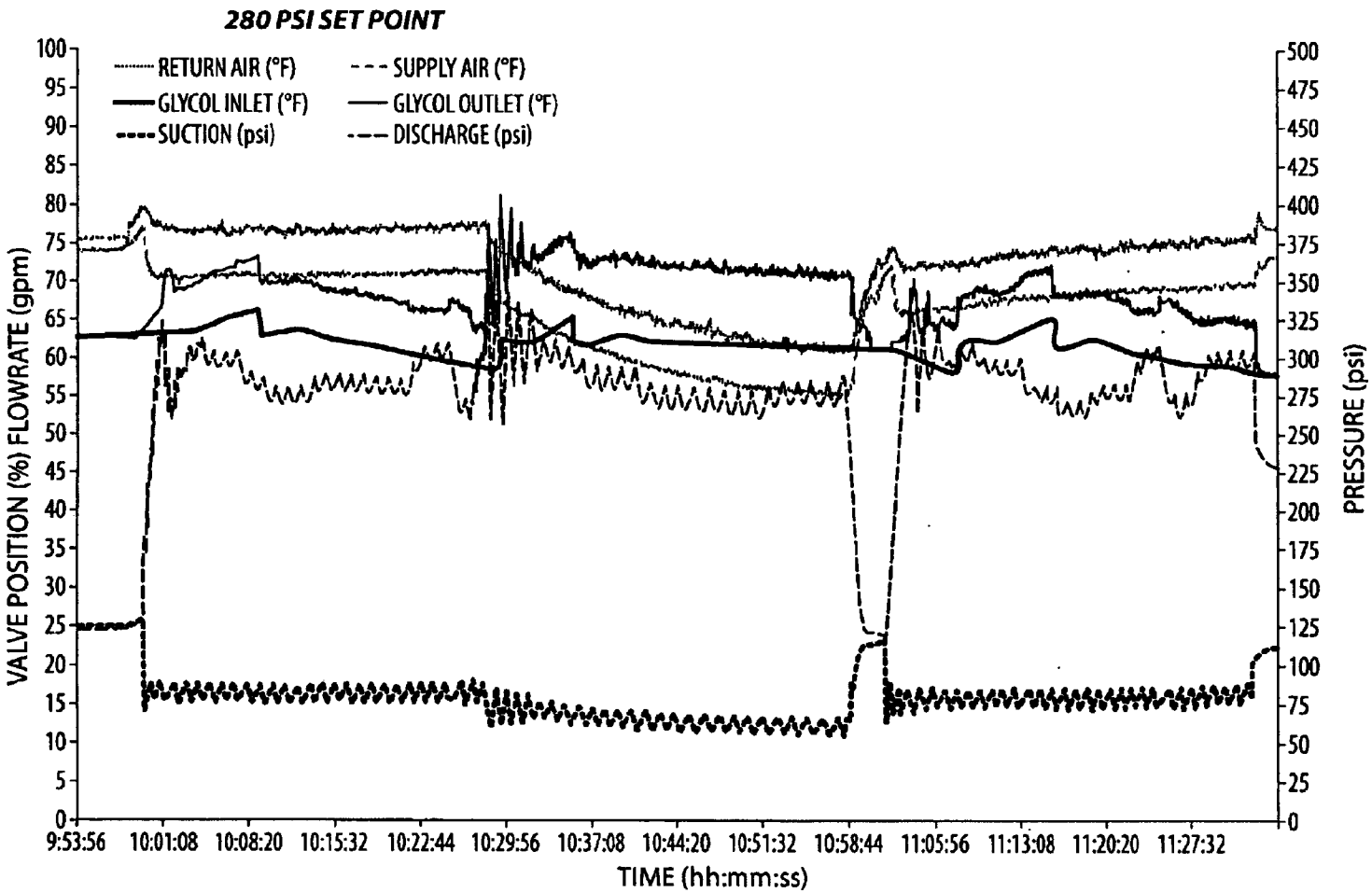
FIG. 5 is a graph depicting more results of the operation of one embodiment of the system of FIG. 1.

With reference to FIG. 5, more results of the operation of one embodiment of the system of FIG. 1 include return air, supply air, glycol outlet, and glycol inlet all in Fahrenheit. FIG. 5 also shows the discharge pressure and suction pressure in psi as shown in FIG. 4. The X axis again represents time in a hours, minutes, seconds format. The left-hand Y axis represents temperature in Fahrenheit and the right-hand Y axis represents pressure in psi. As illustrated, the return air is generally warmer than the supply air and the glycol outlet is generally warmer than the glycol inlet.

Having thus described at least one illustrative embodiment of the invention, various alterations, modifications and improvements are contemplated by the invention including the following: the A/D converter 50 can be embedded in the pressure transducer 18; the controller can be implemented in hardware, e.g., using an application specific integrated circuit; the actuator could be made integral to the flow control valve; and the working fluid (e.g., the coolant) could enter the system at a location other than at the condenser. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A method for regulating coolant fluid flow in a condenser of a vapor compression refrigeration system including a compressor, the method comprising:

providing a controller;

receiving signals at the controller representative of a monitored discharge pressure in a discharge line of the compressor; and using the controller to provide a control signal to an actuator that controls a flow control valve that, in turn, controls coolant fluid flow into the system, the control signal being responsive at least in part to a difference between a set point pressure and the monitored discharge pressure, wherein using the controller to provide a control signal to the actuator comprises:

if the controller is in a hold position state, if the monitored discharge pressure minus the set point pressure is above a pre-selected value, and if the monitored discharge pressure is not decreasing, then entering an opening valve state; and if the controller is in the hold position state, if the monitored discharge pressure minus the set point pressure is below a pre-selected value and if the monitored discharge pressure is not increasing, then entering a closing valve state.

2. The method of claim 1, wherein using the controller to provide a control signal to the actuator further comprises:

if the controller is in an opening valve state, if the monitored discharge pressure minus the set point pressure is below a preselected value, and if the rate of change in the monitored discharge pressure is below a preselected value, then entering the hold position state; and if the controller is in a closing valve state, if the monitored discharge pressure minus the set point pressure is above a preselected value and if the rate of change in the monitored discharge pressure is below a preselected value, then entering the hold position state.

3. The method of claim 1, wherein using the controller to provide a control signal to the actuator further comprises:

if the controller is in an opening valve state and if the monitored discharge pressure is decreasing, then entering a pressure decreasing state; and if the controller is in a closing valve state and if the monitored discharge pressure is increasing, then entering a pressure increasing state.

4. The method of claim 3, wherein using the controller to provide a control signal to the actuator further comprises:

if the controller is in the pressure decreasing state and if the monitored discharge pressure is increasing, then entering the opening valve state; and if the controller is in the pressure increasing state and if the monitored discharge pressure is decreasing, then entering the closing valve state.

5. The method of claim 1, wherein using the controller to provide a control signal to the actuator further comprises:

when the controller enters the opening valve state, the controller substantially immediately signals the actuator to open the flow control valve a preselected amount; and when the controller enters the closing valve state, the controller substantially immediately signals the actuator to close the flow control valve a preselected amount.

6. The method of claim 5, wherein, while the controller is in the opening valve state, after the controller signals the actuator to open the flow control valve a preselected amount, the controller waits a first off time before signaling the actuator to open the valve further, the first off time being a function of the difference between the monitored discharge pressure and the set point pressure; and wherein, while the controller is in the closing valve state, after the controller signals the actuator to close the flow control valve a preselected amount, the controller waits a second off time before signaling the actuator to close the valve further, the second off time being a function of the difference between the monitored discharge pressure and the set point pressure.

7. The method of claim 6, wherein the first and second off times are re-calculated regularly according to a preselected time period.

8. The method of claim 6, wherein the first off time decreases as the difference between the monitored discharge pressure and the set point pressure increases, and wherein the second off time decreases as the difference between the monitored discharge pressure and the set point pressure increases.

9. The method of claim 8, wherein using the controller to provide a control signal to the actuator further comprises:

sending a control signal to the actuator to set the initial position of the flow control valve; and holding the initial position until the controller receives a transition control signal indicating that the compressor has been turned on.

10. The method of claim 3, wherein, using the controller to provide a control signal to the actuator further comprises:

when the controller enters the pressure decreasing state, the controller substantially immediately signals the actuator to close the flow control valve a preselected amount; and when the controller enters the pressure increasing state, the controller substantially immediately signals the actuator to open the flow control valve a preselected amount.

11. The method of claim 10, wherein, while the controller is in the pressure decreasing state, after the controller signals the actuator to close the flow control valve a preselected amount, the controller waits a first off time before signaling the actuator to open the valve further, the first off time being determined at least in part by the rate at which the pressure is decreasing; and wherein, while the controller is in the pressure increasing state, after the controller signals the actuator to open the flow control valve a preselected amount, the controller waits a second off time before signaling the actuator to open the valve further, the second off time being determined at least in part by the rate at which the pressure is increasing.

12. The method of claim 1, wherein the controller is a microprocessor controller.

13. The method of claim 1, wherein the method further comprises:

monitoring the actual discharge pressure using a pressure transducer mounted on the discharge line to produce an analog monitored discharge pressure signal.

14. The method of claim 13, wherein the method further comprises:

using an analog op-amp to convert the analog monitored discharge pressure signal to an adjusted monitored discharge pressure signal.

15. The method of claim 14, wherein the method further comprises:

using an analog-to-digital converter to convert the adjusted monitored discharge pressure signal to a digital monitored discharge pressure signal for forwarding to the controller.

* * * * *